US006736349B1

(12) United States Patent
Boisdon et al.

(10) Patent No.: US 6,736,349 B1
(45) Date of Patent: May 18, 2004

(54) DEVICE FOR SUPPORTING A STRIP IN THE WOUND OR SPOOLED CONDITION

(75) Inventors: Olivier Boisdon, Saint Leger Des Bois (FR); Stéphane Mabit, La Chapelle Saint Sauveur (FR); Régis Barre, La Chapelle Saint Sauveur (FR); Mickaël Hinry, Freigne (FR); Frédéric Pellerin, Mesanger (FR)

(73) Assignee: Zih Corp., Wilmington, DE (US)

( * ) Notice: Subject to any disclaimer, the term of this patent is extended or adjusted under 35 U.S.C. 154(b) by 0 days.

(21) Appl. No.: 10/309,131

(22) Filed: Dec. 4, 2002

(51) Int. Cl.[7] ..... B65H 75/14; B65H 75/24

(52) U.S. Cl. ..... 242/578; 242/578.2; 242/609.1; 242/609.2; 242/609.4; 242/118.61

(58) Field of Search ..... 242/578, 578.1, 242/578.2, 578.3, 609.1, 609.2, 609.3, 609.4, 118.61, 118.62

(56) References Cited

U.S. PATENT DOCUMENTS 3,334,841 A * 8/1967 Burhop ..... 242/118.61
3,743,209 A * 7/1973 Anderson ..... 242/609.1
3,905,561 A * 9/1975 Kelch et al. ..... 242/609.1
4,083,513 A * 4/1978 Pfarrawaller ..... 242/118.62
5,622,333 A * 4/1997 Jacques ..... 242/578.2
6,102,327 A * 8/2000 Ripplinger ..... 242/609.1
6,130,699 A * 10/2000 Christensen et al. ..... 347/218
6,588,697 B2 * 7/2003 Kitayama ..... 242/118.61

* cited by examiner

*Primary Examiner*—John M. Jillions
(74) *Attorney, Agent, or Firm*—Young & Thompson

(57) ABSTRACT

A device for supporting a strip in the wound or spooled condition, includes two half-hubs each having at least one flange (1A, 2A) made by molding with the half-hub, these half-hubs being assembleable together to form a spool. At least one of the half-hubs, called reversible, has a flange (2A) off centered in the direction of the length of the half-hub and is shaped to connect to the other half-hub (1) by either one of its ends (3A, 3B) as a function of the spacing desired between flanges (1 A, 2A).

11 Claims, 3 Drawing Sheets

DEVICE FOR SUPPORTING A STRIP IN THE WOUND OR SPOOLED CONDITION

The present invention relates to a device for supporting a strip in the wound or spooled condition, of the type constituting two half-hubs each bearing at least one flange made by molding with the half-hub, these half-hubs being assembled together to form a spool.

It relates more particularly to a device for supporting a transparent film strip present in the form of alignment of panels disposed side by side and connected to each other by a connection with a rupture starter, each panel being adapted to cover a pre-printed plastic card so as to protect it, this panel being held secured to the card by hot pressing. Until now, this type of strip is wound on a simple hub such that an offset of the edges of the strip cannot be prevented during transport or handling of the hub loaded with the strip. This offset ultimately generates imperfect covering of the card.

To solve this problem, it has been decided to use a spool whose flanges guide the edges of the strip and prevent offset of said edges. However, the strips exist in at least two widths. The design of a device for supporting the strip in the form of a monobloc assembly thus requires providing two stocks of spools.

There are moreover known, as shown in particular in U.S. Pat. No. 6,130,699, spools of which one of the flanges is axially movable along a hub to adapt to different lengths of strip. Such a design requires for each spool a precise adjustment of the flange and immobilization generally by screwing the flange on said hub. These different operations require long assembly time for the spool.

An object of the present invention is thus to overcome the mentioned drawbacks by providing a support device for a strip whose design permits its rapid adaptation to at least two widths of strip.

To this end, the invention has for its object a device for supporting a strip in the wound or spooled condition, of the type constituted by two half-hubs each comprising at least one flange made by molding with the half-hub, these half-hubs being assembleable together to form a spool, characterized in that at least one of the half-hubs, so called reversible, has a flange off center in the direction of the length of the half-hub and is shaped to connect to the other half-hub by one or the other of its ends as a function of the desired spacing between the flanges.

The invention will be better understood from the reading of the following description of embodiments, with reference to the accompanying drawings, in which.

Figure 1A:
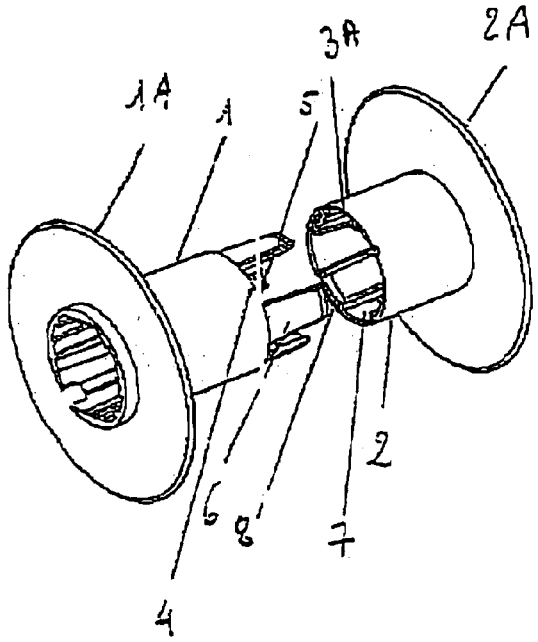
FIG. 1 is a partial perspective view of the support device ready to be assembled (seen at left) and in the assembled condition (seen at right)

As mentioned above, the support device according to the invention is more particularly adapted for the support of a strip present in the form of a transparent film constituted by an assembly of panels disposed side by side and interconnected by a connection with a starting tear.

The device according to the invention supports the strip in the wound or spooled condition and is constituted by two half-hubs 1 and 2 each having at least one flange shown respectively at 1A and 2A in the drawings. Generally, the half-hub 1, 2 is made of synthetic material, the flange 1A, 2A being made by molding with the half-hub. The half-hub is generally a hollow shaft and the flange has the shape of a hollowed disk extending substantially perpendicularly to the longitudinal axis of the hub.

Figure 1B:
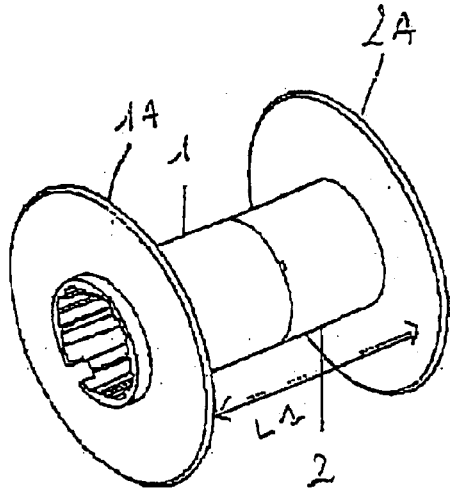
Figure 2A:
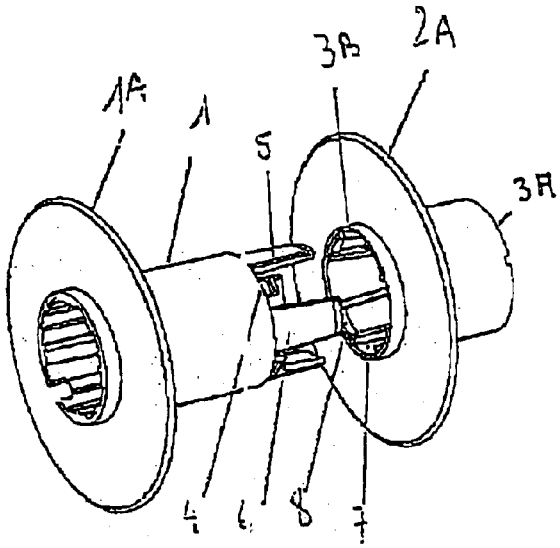
FIG. 2 is a schematic perspective view of the support device ready to be assembled (seen at left) and in the assembled condition (seen at right) in a configuration in which the flanges are spaced by a distance L2 less than that shown in FIG. 1.
Figure 2B:
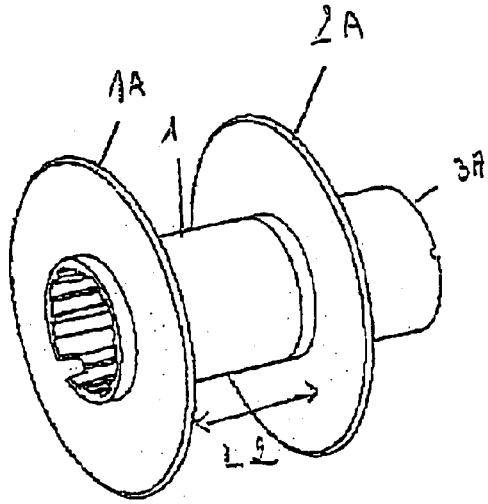
Figure 3:
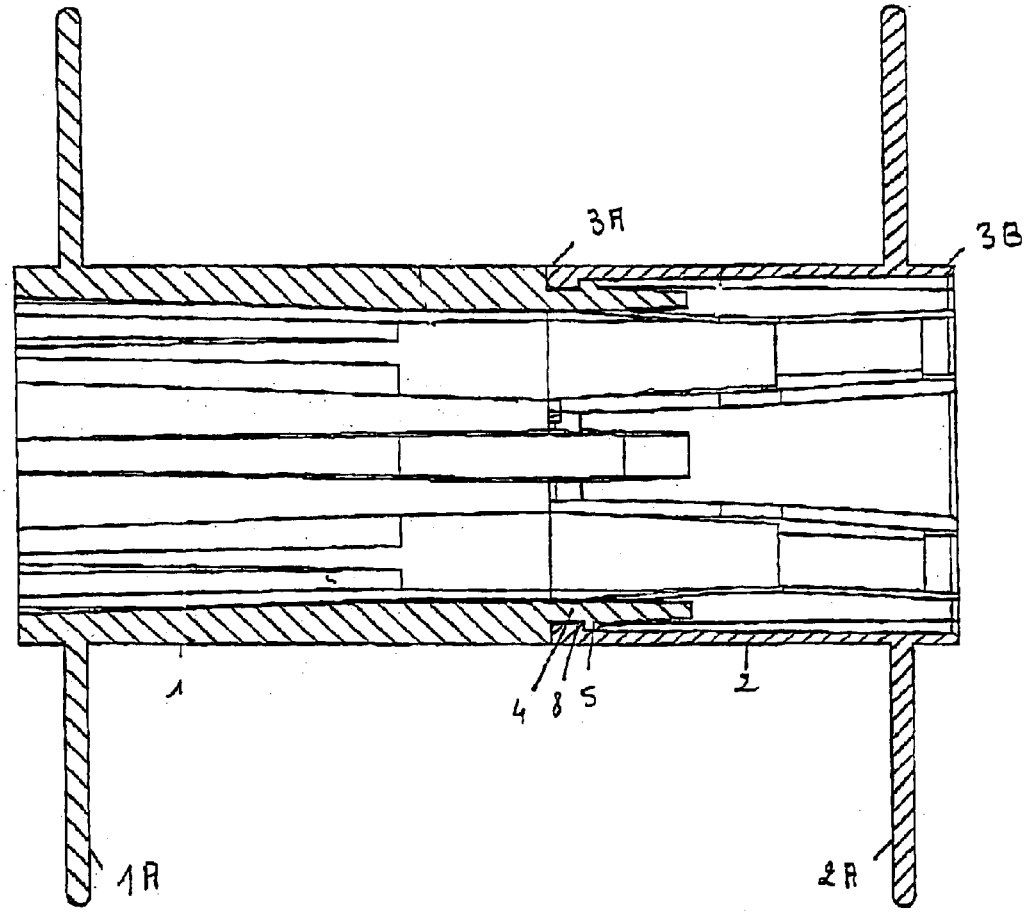
FIG. 3 is a cross-sectional view of FIG. 1 in the assembled condition of the half-hubs so as to show the detail of the snap connection.

The half-hubs 1 and 2 are assembleable together to form a spool as shown in the right hand views in FIGS. 1 and 2. At least one of the half-hubs, shown at 2 in the drawings, has a flange 2A that is off center in the direction of the length of the half-hub. This flange has two ends 3A, 3B for connection to the other half-hub and can thus be coupled by one or the other of its ends to the other half-hub as a function of the spacing L1, L2 desired between the flanges 1A, 2A. This half-hub 2 is thus called reversible.

The two half-hubs 1 and 2 can be assembled by means of a permanent connection. These two half-hubs can also be assembled by means of a disassembleable connection. Thus, these two half-hubs 1, 2 can be assembleable by interengagement of complementary geometric shapes and in particular assembleable by snapping in as shown in the drawings. In this case, the end of the half-hub 1 that is not reversible, has a plurality of resiliently deformable fingers 4 formed by axial prolongations of said half-hub 1. These resiliently deformable fingers 4, disposed in a circle concentric to the half-hub 1, are provided, on their external surface, with hooks 5 coacting with complementary hooks 8 provided on the internal periphery of the reversible half-hub 2 at or adjacent each end 3A, 3B for connection with the reversible hub 2. Thus, during assembly together of the two half-hubs 1, 2, the hooks 5 of the half-hub 1 non-reversibly lock behind the hooks 8 of the reversible half-hub 2, the fingers 4 carrying the hooks 5 resiliently deforming upon insertion of the hooks 8 during assembly of said half-hubs 1, 2 together. These hooks 5, 8 are formed in a single piece with the fingers 4 or with the body of the hub 2 and are constituted simply by a thickening of material over an expansion at the level of said hook. The hooks 8 are angularly offset from one end 3A of connection of the half-hub 2, to the other end 3B of connection to facilitate unmolding of the half-hub 2.

The resiliently deformable fingers 4 alternate with non-deformable fingers 6, called guiding fingers, sliding respectively along a longitudinal rail 7 provided on the internal periphery of the reversible half-hub 2 to be assembled during assembly of the half-hubs 1, 2 together. There is thus a centering and perfect positioning of the two half-hubs 1, 2 together. These rails are generally provided by simple longitudinal ribs provided on the internal periphery of the reversible hub 2.

As the reversible half-hub 2 has, at each of its connecting ends 3A, 3B, hooks 8, there is the possibility of using at will either one of the ends for connection of this hub 2 for assembly with the half-hub 1. As a function of the end that is used, the spacing L1, L2 between flanges 1A, 2A will vary. Thus, in FIG. 1, the spacing L1 between flanges 1A, 2A is the spacing which corresponds to the larger possible dimension, whilst in FIG. 2, the spacing L2 between flanges 1A, 2A corresponds to the smallest possible dimension. It could also be envisaged, by modifying the connection between the half-hubs 1 and 2, to have a support device constituted by two reversible half-hubs assembleable to each other by either one of their connecting ends. There would thus result four possibilities of spacing distance between flanges.

Other possibilities for connection between half-hubs could also be envisaged in an equivalent manner. Thus, the two half-hubs could be assembled by gluing. These two half-hubs could also be assembled by screwing or by welding.

Generally, such a support device is, because of the application described above, incorporated in a lamination station and is positioned upstream of a laminating station formed by two heating rollers adapted to press the portion of the strip removed from the support device onto a card, such as a plastic card previously printed. In this case, the support device can be positioned within a cassette, itself disposed within the laminating station.

What is claimed is:

1. Support device for a strip in the wound or spooled condition, of the type constituted by two half-hubs (1, 2) each having at least one flange (1A, 2A) made by molding with the half-hub (1, 2), these half-hubs (1, 2) being assembled together to form a spool, characterized in that at least one (2) of the half-hubs (1, 2), called reversible, has a flange (2A) off centered in the direction of the length of the half-hub (2) and is shaped to connect to the other half-hub (1) by either one of its ends (3A, 3B) as a function of the desired spacing (L1, L2) between flanges (1A, 2A).

2. Support device according to claim 1, characterized in that the half-hubs (1, 2) are assembleable by means of a permanent connection.

3. Support device according to claim 1, characterized in that the half-hubs (1, 2) are assembleable by means of a disassembleable connection.

4. Support device according to claim 1, characterized in that the two half-hubs (1, 2) are assembleable by interfitting of complementary geometric shapes.

5. Support device according to claim 1, characterized in that the two half-hubs (1, 2) are assembleable by snap-fitting.

6. Support device according to claim 1, characterized in that the connecting end of the non-reversible half-hub (1) has a plurality of resiliently deformable fingers (4) formed by axial prolongations of said half-hub (1), these resiliently deformable fingers (4), disposed in a circle concentric to the half-hub (1), being provided on their external surface with hooks (5) cooperating, during assembly of said half-hubs (1, 2) together, with complementary hooks (8) provided on the internal periphery of the reversible half-hub (2) at or adjacent each end (3A, 3B) of connection of the reversible hub (2).

7. Support device according to claim 6, characterized in that the resiliently deformable fingers (4) alternate with non-deformable fingers (6) for guidance, slidable respectively along a rail (7) provided on the internal periphery of the reversible half-hub (2) to be assembled during assembly of the two half-hubs (1, 2) together.

8. Support device according to claim 1, characterized in that the two half-hubs are assembleable by gluing.

9. Support device according to claim 1, characterized in that the half-hubs are assembleable by screwing.

10. Support device according to claim 1, characterized in that the two half-hubs are assembleable by welding.

11. Support device according to claim 1, characterized in that it is incorporated within a laminating station and is positioned upstream of a laminating station formed by two heating rollers adapted to press the portion of the strip separated from the support device, onto a previously printed card.

* * * * *